US006993931B1

(12) United States Patent
Hamilton

(10) Patent No.: US 6,993,931 B1
(45) Date of Patent: Feb. 7, 2006

(54) MULTIFUNCTIONAL COOLER ASSEMBLY

(76) Inventor: Cindy T. Hamilton, 4425 Pitt St., Anderson, IN (US) 46013

( * ) Notice: Subject to any disclaimer, the term of this patent is extended or adjusted under 35 U.S.C. 154(b) by 0 days.

(21) Appl. No.: 10/851,743

(22) Filed: May 24, 2004

(51) Int. Cl.
*F25D 3/08* (2006.01)

(52) U.S. Cl. ..... 62/457.7; 62/371

(58) Field of Classification Search ..... 62/457.1, 62/457.7, 459, 371
See application file for complete search history.

(56) References Cited

U.S. PATENT DOCUMENTS 4,652,048 A 3/1987 Nazar
D298,186 S 10/1988 Brannon
5,050,767 A 9/1991 Peer
5,100,198 A 3/1992 Baltzell
5,269,157 A 12/1993 Ciminelli et al.
5,407,218 A 4/1995 Jackson
5,480,170 A 1/1996 Kaiser, II
6,374,839 B2 * 4/2002 Patarra ..... 135/16
6,474,097 B2 * 11/2002 Treppedi et al. ..... 62/457.7
6,554,012 B2 4/2003 Patarra

* cited by examiner

*Primary Examiner*—Melvin Jones

(57) ABSTRACT

A portable cooler and adjustable chair has a body, wheels, an insulating layer traveling about a perimeter of the body, a tray slidably positioned within the cavity, and a housing secured to the body for receiving a bottom portion of an umbrella. A foldable chair is slidably positioned on top of the body and can be folded between raised and lowered positions. A lid is provided adjacent the chair for allowing a user to access foodstuff disposed within the body cavity. Also, a handle is provided so that a user can readily transport the cooler by pivot same about the wheels applying motive force in a desired direction.

16 Claims, 6 Drawing Sheets

MULTIFUNCTIONAL COOLER ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a portable cooler and, more particularly, to a multifunctional cooler assembly that provides means for sitting.

2. Prior Art

Individuals who go to the beach for swimming, sunbathing and the like frequently carry various items to enhance their enjoyment of beach activities. Such items may include a beach chair, beach umbrella, blanket, towels, radio, an insulated cooler for beverages and food products and various personal items. These items are usually bulky and difficult to handle and control while walking to and from the beach. Some efforts have been made to provide carrying bags and the like for some of the above-mentioned items. However, there is still a substantial need for improved devices for use by beach goers to facilitate various utilitarian items being carried to and from the beach.

It has become increasingly popular to picnic in places where a table or other support surfaces are not available. Typically, a cooler or other container is carried to the desired location. This can be very exhausting if the desired location is inconvenient to roads or other means of transportation.

Known folding chairs constructed of tubular aluminum with nylon or canvas covering material or the like are well known. These portable chairs have the virtue of being very light to carry and provide an inexpensive means for comfortable reclining. Many conventional chairs require the occupant to sit near the ground and are sometimes provided with short legs. To spend the day at the beach, conventional practice involves using and carrying a comfortable chair, a portable cooler for beverages and lunches, and a container to hold towels and other small articles.

This conventional practice is relatively expensive and cumbersome to carry. Known folding chairs have the disadvantage of not possessing any storage facilities which can both hold small articles and thermally insulate perishable foodstuffs and bottled beverages. A number of alternative means have been proposed to overcome some of the difficulties with conventional chairs. For example, several chairs have been devised with storage capability for beach or camping.

A variety of tackle box chairs and beach chairs exist and while each serves a specific purpose, the alternative means provided require insulating and carrying means, and are sometimes difficult to access without standing. Many of the alternatives available suffer from tipping or require the occupant to sit very low to the ground, and some are quite cumbersome to carry. Still others are provided with a back prop of such a design as to cause the occupant serious injury if suddenly collapsed.

Problems with prior devices include not providing a unified umbrella, not providing food supporting table surfaces of selectable height and not providing wheel and handle transport means. Furthermore, the prior art lacks the advantages of a caddy device, and otherwise fails to satisfy a need in the art for a versatile, durable, compact and transportable cooler/table structure which can be manufactured relatively inexpensively.

Accordingly, a need remains for a caddy-like multifunctional cooler assembly, which overcomes the above-noted shortcomings.

BRIEF SUMMARY OF THE INVENTION

In view of the foregoing background, it is therefore an object of the present invention to provide a multifunctional cooler assembly that provides a means for sitting. These and other objects, features, and advantages of the invention are provided by a portable assembly including a combined cooler and adjustable chair that has a body defining a cavity therein and a centrally disposed longitudinal axis extending therethrough. Such a body further has proximal and distal end portions spaced along the axis.

Furthermore, the body has a pair of side portions oppositely spaced from the axis and a top surface pivotally attached to one side portion for providing access to the cavity. A quick-release latch is included for locking the top surface to another side portion during transportation. Of course, various well known locking members may be employed without departing from the true scope of the invention.

Advantageously, the present invention further includes a plurality of wheels mounted to the distal end portion so that an operator can transport the body by lifting the proximal end portion along a select arcuate path and applying motive force in a predetermined direction.

The present invention further includes an insulating layer traveling about a perimeter of the body for assisting to preserve foodstuff disposed within the cavity. The present invention may further include a tray adjustably positionable within the cavity and at an elevated level. Such a tray is slidably mounted subjacent the top surface so that an operator can readily access foodstuff contained within the tray.

Advantageously, the present invention further includes an elongated hollow housing secured to the body and disposed substantially perpendicular to the axis. Such a housing has a select length for receiving a bottom portion of an umbrella shaft therein to thereby maintain the umbrella at a substantially vertical position during operating conditions.

The present invention further includes a handle pivotally connected to the proximal end portion that is movable between first and second positions for assisting an operator to transport the assembly between remote locations.

The present invention may further include a plurality of pouches secured to the pair of side portions respectively and extending substantially parallel to the axis. Such a plurality of pouches include respective top portions selectively movable between open and closed positions for receiving objects therein.

The present invention may further include a lid slidably attached adjacent the distal end portion and is contiguous with the top surface. Such a lid is selectively movable along a substantially horizontal plane so that an operator can readily access the cavity while seated on the body. Furthermore, the present invention includes a continuous seal coupled to the perimeter of the body and cooperating with the lid for assisting to maintain the cavity at a select temperature.

Advantageously, the present invention further includes a chair having a seat section and a back section pivotally connected thereto wherein the back section is movable between lowered and raised positions. The top surface of the body has a plurality of slots formed therein and extending substantially orthogonal to the axis for receiving and maintaining the seat section at a substantially stable position.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
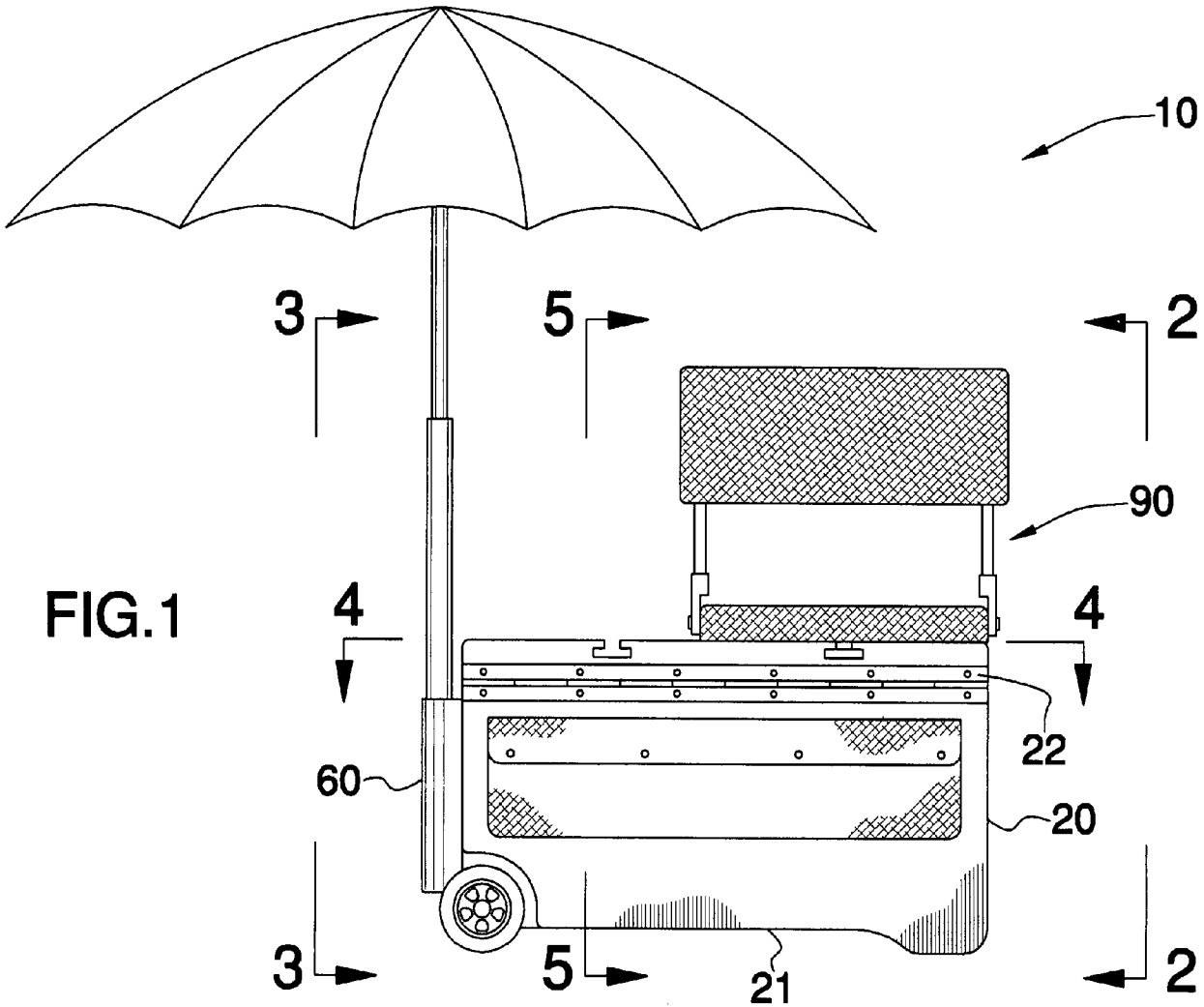
FIG. 1 is a front elevational view showing a multifunctional assembly that includes a cooler, an umbrella, and a chair, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1–6 by the reference numeral 10 and is intended to provide a multifunctional cooler assembly that provides means for sitting. It should be understood that the assembly 10 fulfills a variety of needs that are common during outdoor activities.

Figure 2:
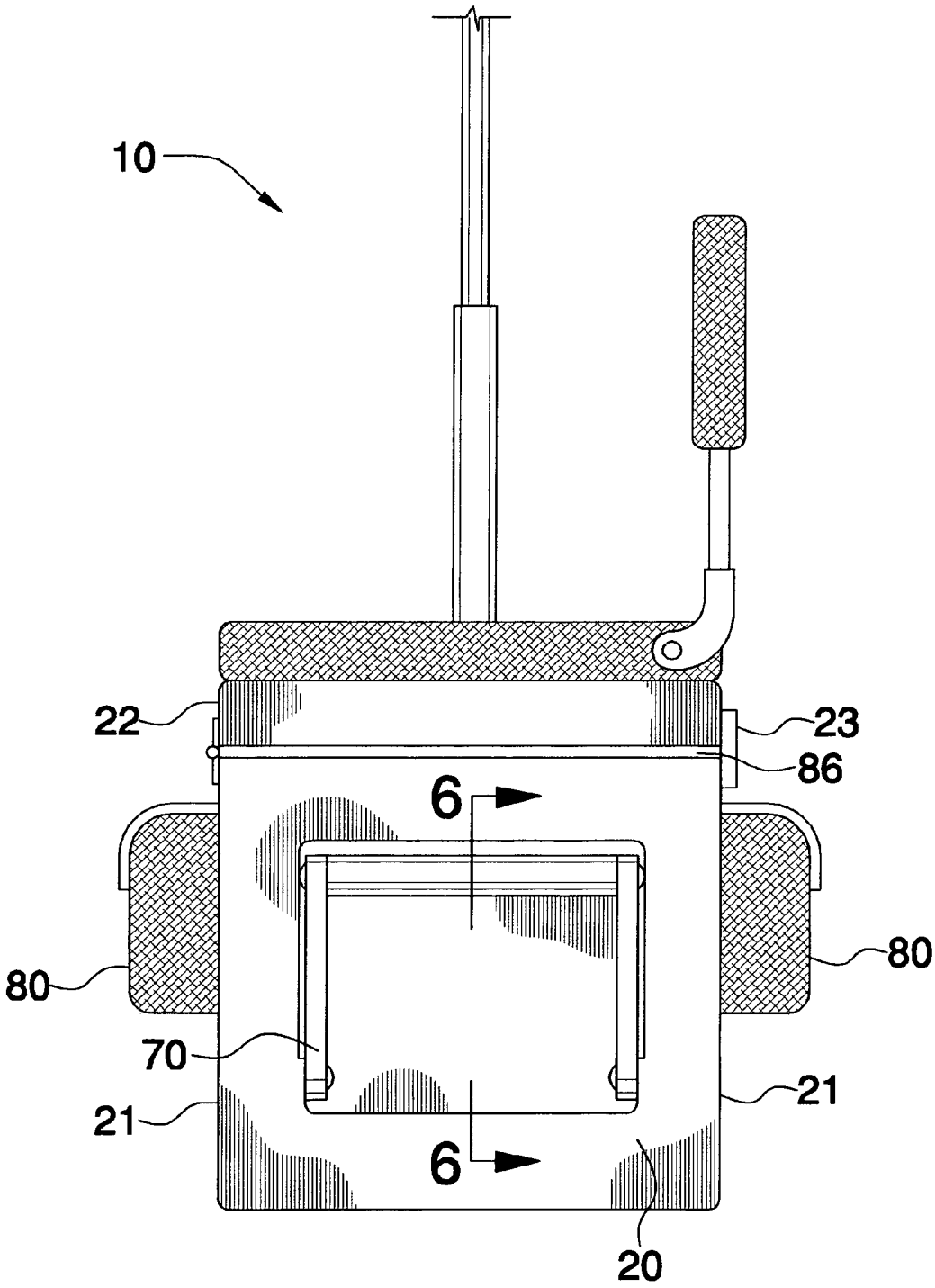
FIG. 2 is a left side elevational view of the present invention shown in FIG. 1 taken along line 2—2.

Referring initially to FIGS. 1 and 2, the assembly 10 includes a body 20 defining a cavity therein and a centrally disposed longitudinal axis extending therethrough. Such a body 20 further has proximal and distal end portions spaced along the axis.

The body 20 also has a pair of side portions 21 oppositely spaced from the axis and a top surface 22 pivotally attached to one side portion for providing access to the cavity. A quick-release latch 23 is included for locking the top surface to another side portion during transportation. Of course, various well known locking members may be employed without departing from the true scope of the invention.

Figure 3:
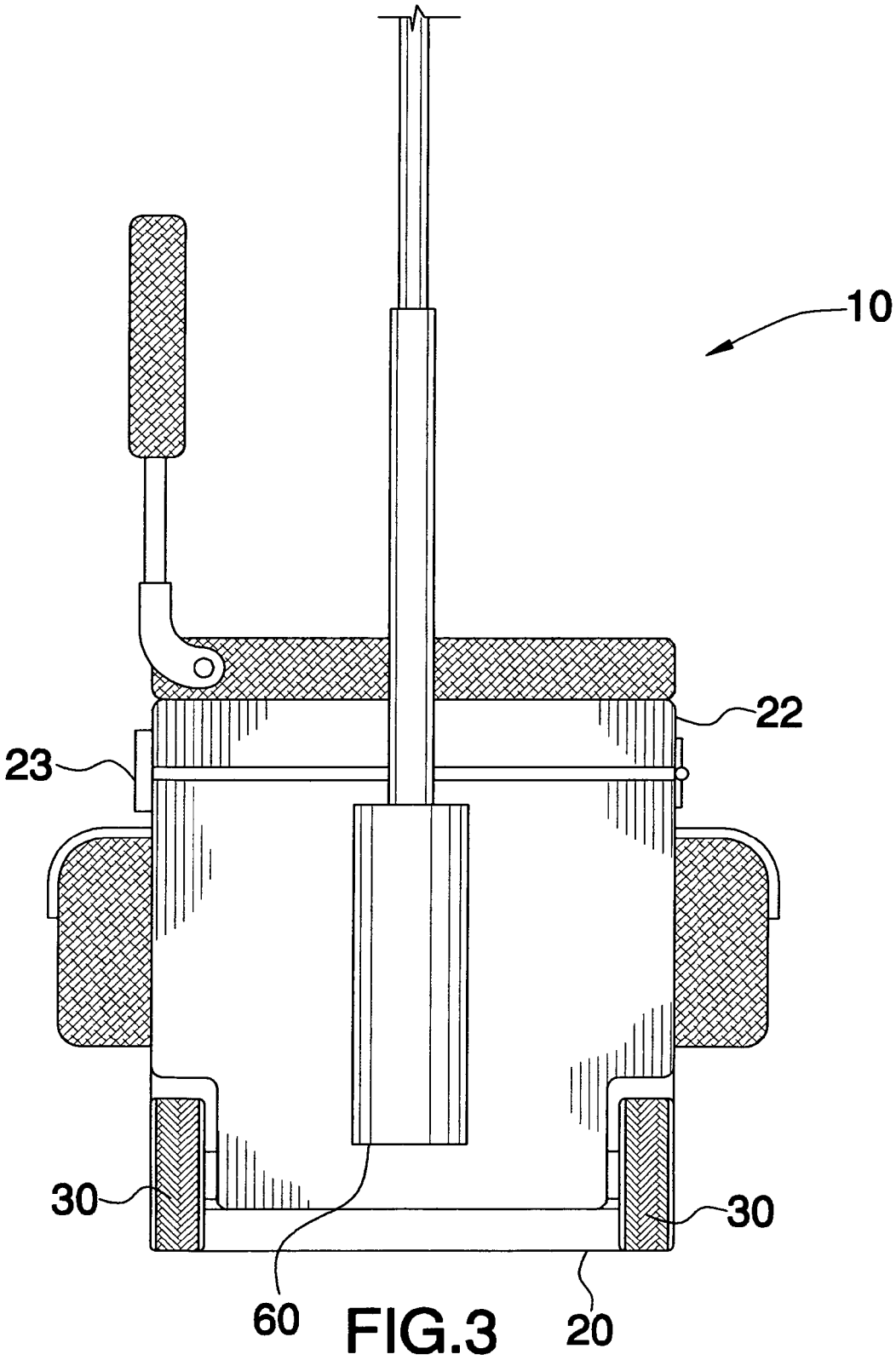
FIG. 3 is a right side elevational view of the present invention shown in FIG. 1 taken along line 3—3.

Referring to FIGS. 1 and 3, the present invention advantageously includes a plurality of wheels 30 mounted to the distal end portion so that an operator can transport the body 20 by lifting the proximal end portion along a select arcuate path and applying motive force in a predetermined direction. Often, a trip to the beach, for example, involves carrying several items such as an umbrella, a chair, and a cooler. Such items are heavy and tedious to carry and may require several trips to and from the vehicle before the user can arrange them on the beach. The present invention overcomes such a shortcoming by providing a mobile cooler wherein the user can simultaneously transport multiple items during a single trip.

Figure 5:
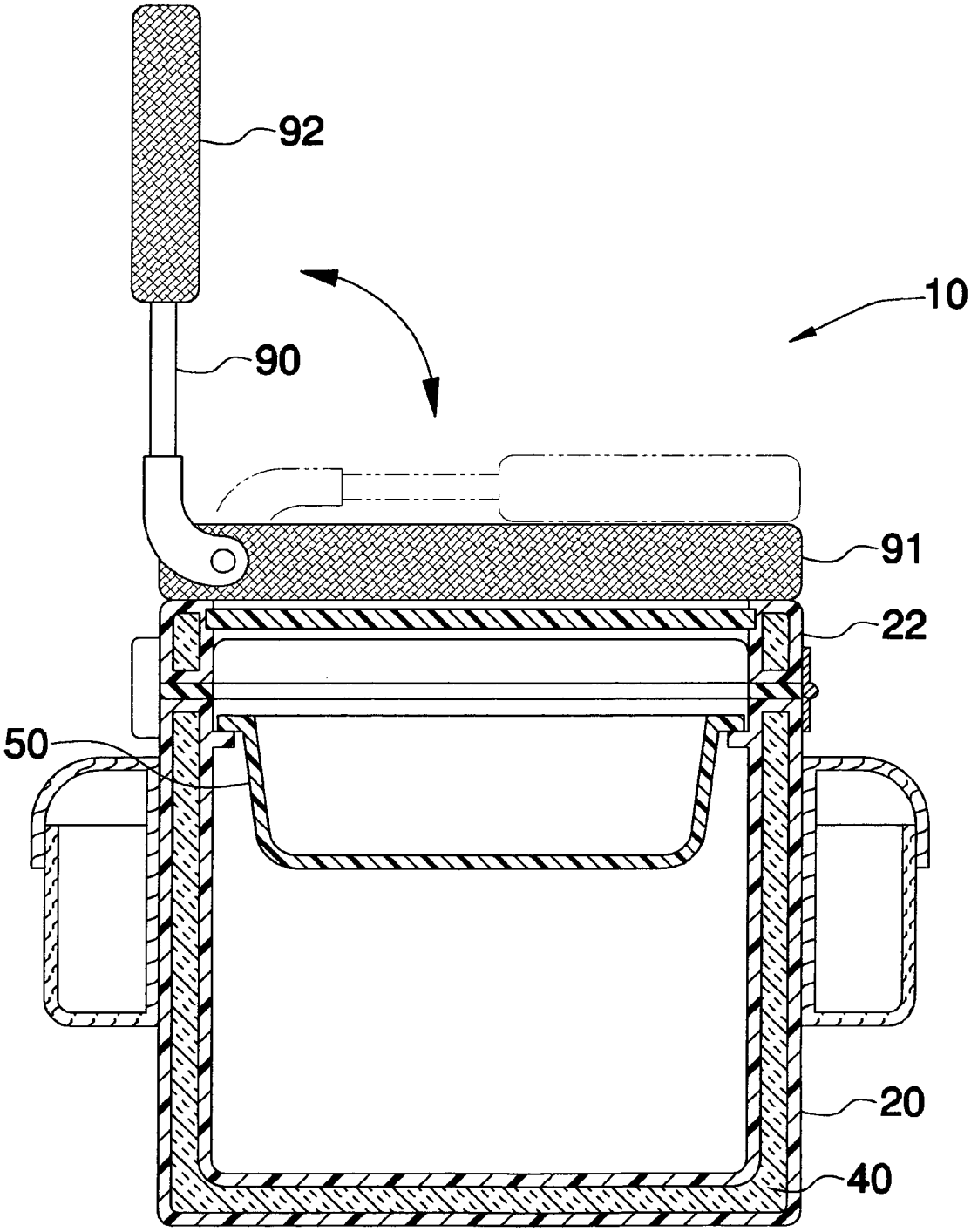
FIG. 5 is a cross-sectional view of the present invention shown in FIG. 1 taken along 5—5 wherein the tray is slidably supported within the cavity.

Referring to FIG. 5, the present invention further includes an insulating layer 40 traveling about a perimeter of the body 20 for assisting to preserve foodstuff disposed within the cavity. The present invention may further include a tray 50 adjustably positionable within the cavity and at an elevated level. Such a tray 50 is slidably mounted subjacent the top surface 22 so that an operator can readily access foodstuff contained within the tray 50.

Referring to FIG. 3, the present invention advantageously includes an elongated hollow housing 60 secured to the body 20 and disposed substantially perpendicular to the axis. Such a housing 60 has a select length for receiving a bottom portion of an umbrella shaft therein to thereby maintain the umbrella at a substantially vertical position during operating conditions. Large umbrellas are often needed to provide adequate shade at the beach. Such umbrella are difficult to carry and mount in the sand. The present invention overcomes this shortcoming by providing a rigid housing 60 for receiving an umbrella pole and allowing a user to more conveniently access shade during a hot day.

Figure 6:
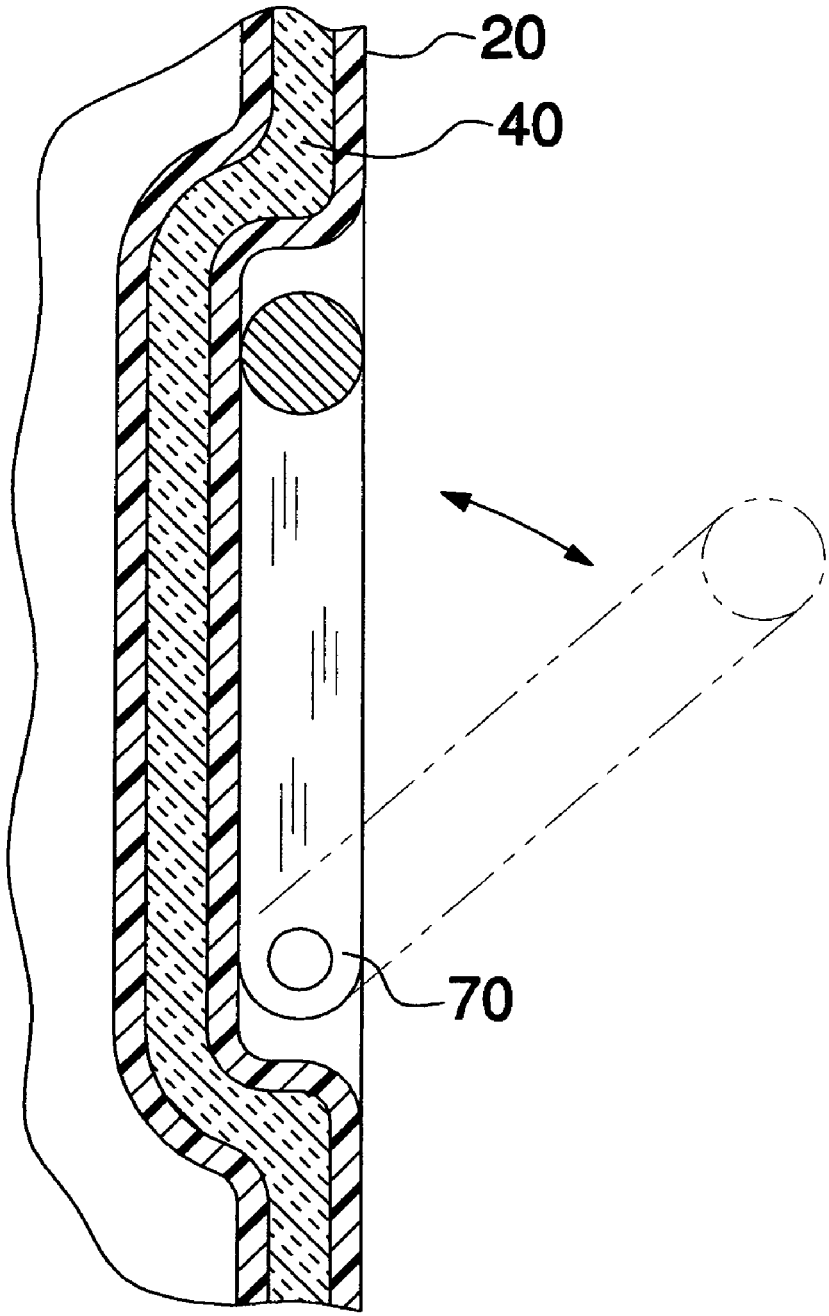
FIG. 6 is a cross-sectional view of the pivotal handle shown in FIG. 2 taken along line 6—6.

Referring to FIGS. 2 and 6, the present invention further includes a handle 70 pivotally connected to the proximal end portion that is movable between first and second positions for assisting an operator to transport the assembly 10 between remote locations.

Referring to FIG. 2 in more detail, the present invention may further include a plurality of pouches 80 secured to the pair of side portions 21 respectively and extending substantially parallel to the axis. Such a plurality of pouches 80 include respective top portions selectively movable between open and closed positions for receiving objects therein.

Figure 4:
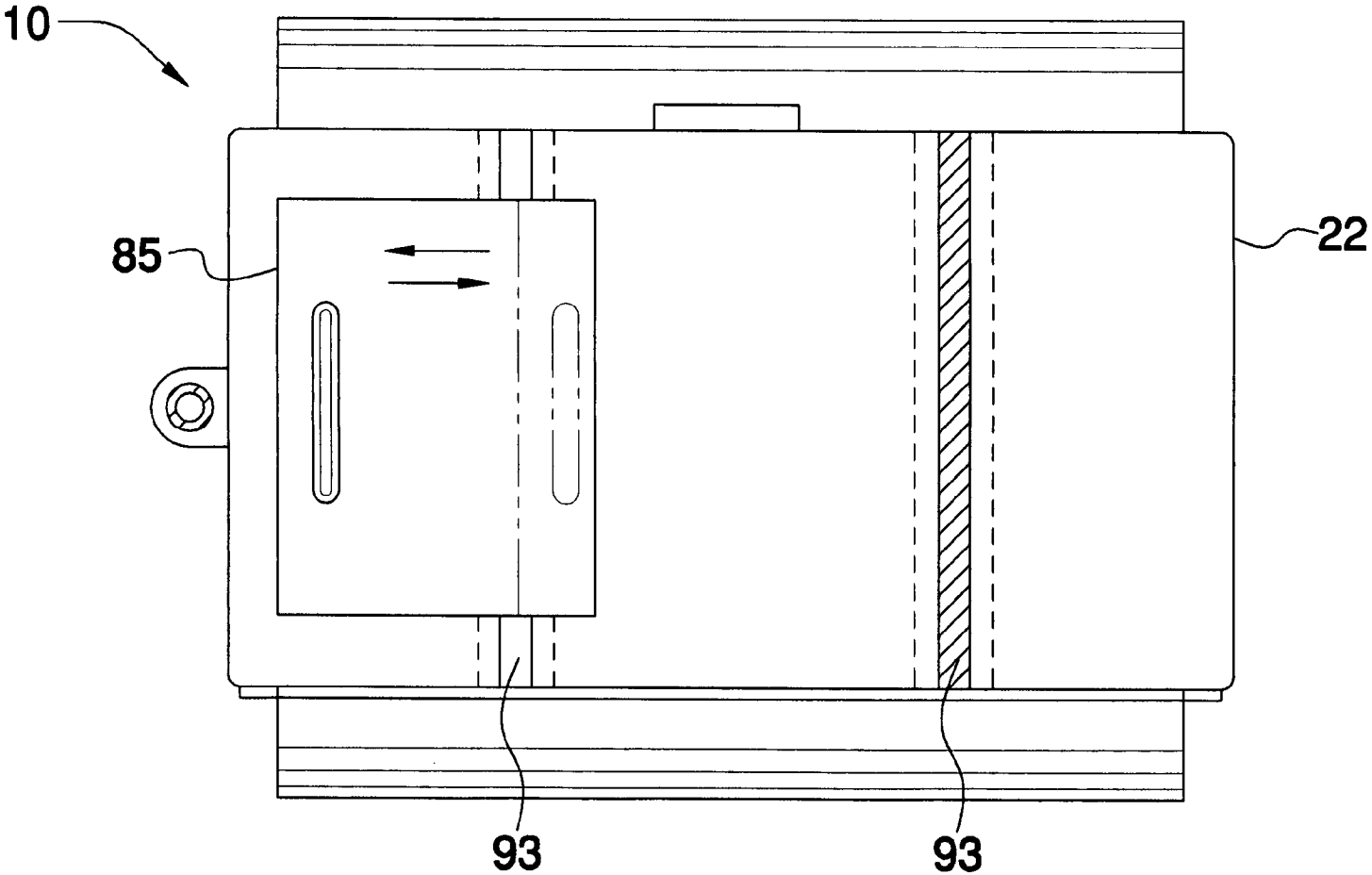
FIG. 4 is a partial top plan view of the present invention shown in FIG. 1 taken along line 4—4.

Referring to FIG. 4, the present invention further includes a lid 85 slidably attached adjacent the distal end portion and is contiguous with the top surface 22. Such a lid 85 is selectively movable along a substantially horizontal plane so that an operator can readily access the cavity while seated on the body 20. Furthermore, the present invention includes a continuous seal 86 coupled to the perimeter of the body 20 and cooperating with the lid 85 for assisting to maintain the cavity at a select temperature.

Referring to FIGS. 4 and 5 in more detail, the present invention advantageously includes a chair 90 having a seat section 91 and a back section 92 pivotally connected thereto wherein the back section is movable between lowered and raised positions. The top surface of the body 22 has a plurality of slots 93 formed therein and extending substantially orthogonal to the axis for receiving and maintaining the seat section 91 at a substantially stable position. Coolers are often used as chairs during outside activities but are uncomfortable and do not provide back support. The chair 90 provides a user with a more comfortable and supportive place to sit while having access to foodstuff stored in the cooler.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A portable assembly for providing a combined cooler and adjustable chair, said assembly comprising:

a body defining a cavity therein and having a centrally disposed longitudinal axis, said body further having proximal and distal end portions spaced along the axis, said body further having a pair of side portions oppositely spaced from the axis and a top surface pivotally attached to one said pair of side portions for providing access to the cavity, said body comprising a plurality of wheels mounted to said distal end portion so that an operator can transport said body by lifting said proximal end portion along a select arcuate path and applying motive force in a predetermined direction, and an insulating layer traveling about a perimeter of said body for assisting to preserve foodstuff disposed within the cavity;

an elongated hollow housing secured to said body and disposed substantially perpendicular to the axis, said housing having a select length for receiving a bottom portion of an umbrella shaft therein to thereby maintain the umbrella at a substantially vertical position during operating conditions;

a handle pivotally connected to said proximal end portion and being movable between first and second positions for assisting an operator to transport said assembly between remote locations; and a quick-release latch for locking said top surface to another said pair of side portions.

2. The portable assembly of claim 1, further comprising: a plurality of pouches secured to said pair of side portions respectively and extending substantially parallel to the axis, said plurality of pouches including respective top portions selectively movable between open and closed positions for receiving objects therein.

3. The portable assembly of claim 1, further comprising: a lid slidably attached adjacent said distal end portion and being contiguous with said top surface, said lid being selectively movable along a substantially horizontal plane so that an operator can readily access the cavity while seated on said body.

4. The portable assembly of claim 1, further comprising: a chair having a seat section and a back section pivotally connected thereto wherein said back section is movable between lowered and raised positions, said top surface having a plurality of slots formed therein and extending substantially orthogonal to the axis for receiving and maintaining said seat section at a substantially stable position.

5. The portable assembly of claim 1, further comprising: a tray adjustably positionable within the cavity and at an elevated level, said tray being slidably mounted subjacent said top surface so that an operator can readily access foodstuff contained within said tray.

6. The portable assembly of claim 1, further comprising: a continuous seal coupled to the perimeter of said body and cooperating with said lid for assisting to maintain the cavity at a select temperature.

7. A portable assembly for providing a combined cooler and adjustable chair, said assembly comprising:

a body defining a cavity therein and having a centrally disposed longitudinal axis, said body further having proximal and distal end portions spaced along the axis, said body further having a pair of side portions oppositely spaced from the axis and a top surface pivotally attached to one said pair of side portions for providing access to the cavity, said body comprising a plurality of wheels mounted to said distal end portion so that an operator can transport said body by lifting said proximal end portion along a select arcuate path and applying motive force in a predetermined direction, and an insulating layer traveling about a perimeter of said body for assisting to preserve foodstuff disposed within the cavity;

an elongated hollow housing secured to said body and disposed substantially perpendicular to the axis, said housing having a select length for receiving a bottom portion of an umbrella shaft therein to thereby maintain the umbrella at a substantially vertical position during operating conditions;

a handle pivotally connected to said proximal end portion and being movable between first and second positions for assisting an operator to transport said assembly between remote locations;

a plurality of pouches secured to said pair of side portions respectively and extending substantially parallel to the axis, said plurality of pouches including respective top portions selectively movable between open and closed positions for receiving objects therein; and a quick-release latch for locking said top surface to another said pair of side portions.

8. The portable assembly of claim 7, further comprising: a lid slidably attached adjacent said distal end portion and being contiguous with said top surface, said lid being selectively movable along a substantially horizontal plane so that an operator can readily access the cavity while seated on said body.

9. The portable assembly of claim 7, further comprising: a chair having a seat section and a back section pivotally connected thereto wherein said back section is movable between lowered and raised positions, said top surface having a plurality of slots formed therein and extending substantially orthogonal to the axis for receiving and maintaining said seat section at a substantially stable position.

10. The portable assembly of claim 7, further comprising: a tray adjustably positionable within the cavity and at an elevated level, said tray being slidably mounted subjacent said top surface so that an operator can readily access foodstuff contained within said tray.

11. The portable assembly of claim 7, further comprising: a continuous seal coupled to the perimeter of said body and cooperating with said lid for assisting to maintain the cavity at a select temperature.

12. A portable assembly for providing a combined cooler and adjustable chair, said assembly comprising:

a body defining a cavity therein and having a centrally disposed longitudinal axis, said body further having proximal and distal end portions spaced along the axis, said body further having a pair of side portions oppositely spaced from the axis and a top surface pivotally attached to one said pair of side portions for providing access to the cavity, said body comprising a plurality of wheels mounted to said distal end portion so that an operator can transport said body by lifting said proximal end portion along a select arcuate path and applying motive force in a predetermined direction, and an insulating layer traveling about a perimeter of said body for assisting to preserve foodstuff disposed within the cavity;

an elongated hollow housing secured to said body and disposed substantially perpendicular to the axis, said housing having a select length for receiving a bottom portion of an umbrella shaft therein to thereby maintain the umbrella at a substantially vertical position during operating conditions;

a handle pivotally connected to said proximal end portion and being movable between first and second positions for assisting an operator to transport said assembly between remote locations;

a plurality of pouches secured to said pair of side portions respectively and extending substantially parallel to the axis, said plurality of pouches including respective top portions selectively movable between open and closed positions for receiving objects therein; and a lid slidably attached adjacent said distal end portion and being contiguous with said top surface, said lid being selectively movable along a substantially horizontal plane so that an operator can readily access the cavity while seated on said body.

13. The portable assembly of claim 12, further comprising: a chair having a seat section and a back section pivotally connected thereto wherein said back section is movable between lowered and raised positions, said top surface having a plurality of slots formed therein and extending substantially orthogonal to the axis for receiving and maintaining said seat section at a substantially stable position.

14. The portable assembly of claim 12, further comprising: a tray adjustably positionable within the cavity and at an elevated level, said tray being slidably, mounted subjacent said top surface so that an operator can readily access foodstuff contained within said tray.

15. The portable assembly of claim 12, further comprising: a quick-release latch for locking said top surface to another said pair of side portions.

16. The portable assembly of claim 12, further comprising: a continuous seal coupled to the perimeter of said body and cooperating with said lid for assisting to maintain the cavity at a select temperature.

* * * * *